US006234319B1

(12) United States Patent
Wang

(10) Patent No.: US 6,234,319 B1
(45) Date of Patent: May 22, 2001

(54) SCREENLESS VIBRATORY SEPARATOR

(75) Inventor: Zhongwu Wang, Beijing (CN)

(73) Assignee: Beijing Qinghua Tiantong Science & Technology Co., Ltd., Beijing (CN)

( * ) Notice: Subject to any disclaimer, the term of this patent is extended or adjusted under 35 U.S.C. 154(b) by 0 days.

(21) Appl. No.: 09/331,585

(22) PCT Filed: Jan. 28, 1997

(86) PCT No.: PCT/CN97/00007

§ 371 Date: Jun. 30, 1999

§ 102(e) Date: Jun. 30, 1999

(87) PCT Pub. No.: WO98/29202

PCT Pub. Date: Jul. 9, 1998

(30) Foreign Application Priority Data

Jan. 2, 1997 (CN) ..... 97 1 00203

(51) Int. Cl.[7] ..... B07B 13/00
(52) U.S. Cl. ..... 209/479; 209/493; 209/504
(58) Field of Search ..... 209/44, 479, 490, 209/493, 503, 504, 505

(56) References Cited

U.S. PATENT DOCUMENTS

| | | | | |
|---|---|---|---|---|
| 836,553 | * | 11/1906 | Bauer | 209/479 X |
| 1,548,536 | * | 8/1925 | MaCartney | 209/479 X |
| 3,003,635 | | 10/1961 | Wood | 209/365.3 X |
| 3,472,379 | | 10/1969 | Lainas | 209/479 |
| 4,978,011 | * | 12/1990 | Gorlitz et al. | 209/504 X |

FOREIGN PATENT DOCUMENTS

| | | | | |
|---|---|---|---|---|
| 63063 | * | 7/1892 | (DE) | 209/479 |
| A1-3721436 | | 1/1989 | (DE) . | |

* cited by examiner

*Primary Examiner*—Tuan N. Nguyen
(74) *Attorney, Agent, or Firm*—Arent Fox Kintner Plotkin & Kahn, PLLC

(57) ABSTRACT

A screenless vibratory separator consists of a trough, support assemblies, a vibrator, a blade and an adjuster for the blade. The trough having a flat bottom plate and two outlets is open, and is supported by the support assemblies. The vibrator is mounted on the trough. When operating, a mixture is stratified into an upper layer and a lower layer which are separated by the blade and are discharged respectively from the outlets.

5 Claims, 4 Drawing Sheets

SCREENLESS VIBRATORY SEPARATOR

This application is the national phase under 35 U.S.C. §371 of PCT International Application No. PCT/CN97/00007 which has an International filing date of Jun. 28, 1997, which designated the United States of America.

BACKGROUND OF INVENTION

1. Field of the Invention

The invention involves a classifying equipment for unequal particles of the same kind or the same density, specially involves a screenless vibratory separator.

2. Description of the Related Art

Screen technique is actually a grading classification according to granularity of particles. Up to now screen equipments and techniques are all based on the knowledge of the related objects. For bulk-variant solid particles a screen with mesh is usually adopted. It essentially utilizes the norm of mesh holes to pick out particles, which leads to low separating efficiency for the reason given below. First of all, the internal forces, namely the effects of galling, dampness and electrostatic force caused by tight material, increase the resisting force through mesh holes. Moreover, under the restriction of mesh holes the particles can only pass through one by one. So the capacity and the speed is largely limited. A vibratory screen with mesh takes advantages of higher efficiency than traditional one without vibration. Typically, it consists of a vibrating screen with mesh, a vibrator and a support system. Vibrating improves the condition that particles get through mesh holes, thus increases the operating efficiency. This makes a great progress relative to the tradition type. However, it doesn't give up the basic principles of screen with mesh, so can't overcome its inherent shortcomings.

All kinds of screen with mesh suffer a great deal of restriction in application because one norm of mesh can only meet the case of one granularity. To classify particles with different granularity, different screen surfaces must be used. To realize it at the same time, multi-screen or combination of screen surfaces must be considered Obviously, this sophisticates the industrial art, raises the costs. What's more, choke, especially in the case of small particles and small mesh holes, often interrupts production, which greatly lowers the efficiency, even disables the screening. The vibratory screen with mesh that makes use of water or air as medium can make up for most of these shortcomings. But the complexity of mechanical structure, the high cost, the waste of water and the fact that some material doesn't fit to be soaked all limit its application. What's worst, breaking of mesh holes usually makes all the previous screen sizing performed by such setup with mesh wasted.

In the mineral-dressing industry, a concentrating machine without mesh is commonly used. For instance, jiggers, both the wind power jigger and the waterpower one, utilize the character rooting in different density, thus separate material of different density. But it can't separate particles according to their granularity. Therefore, strictly sealing, such sieving equipments as jiggers are just accumulating equipments, not screening ones, and can only be applied to special fields.

U.S. Pat. No. 3,472,379 describes a stratifying technique for material, which includes a separating equipment composing of an oblique slot, a vibrator and a support. When operating, the input of the slot does a peripheral motion in a plane and the outlet does a horizontal motion to stratify particles of low density into the upper layer and particles of high density into the lower one as a result of gravity. It's specially pointed out that the technique and equipment can only separate rubber, fiber and similar material with density difference of about 3–4 times. So the application is quite limited In particular, the stratifying technique can't also separate particles by their granularity.

In the industrial and agricultural production, screen by granularity is most necessary. And the foreground is very promising. Therefore developing a new screen equipment with wide application, high efficiency, simply suture and high reliability to overcome the shortcomings of traditional separating techniques and equipments makes an extremely practical sense.

Screen by granularity essentially classifies particles of the same kind or the same density according to the size. Based on this cognizance, we invent a screenless vibratory separator.

SUMMARY OF THE INVENTION

One object of the invention is to overcome the low efficiency of the traditional screen with mesh and to develop a high-efficiency mediumless screening equipment. It bears no restriction of norm, inherent for screen with mesh, and the resisting force when particles passing through. And particles are stratified and separated continuously instead of screened one by one. So the separating efficiency increases greatly.

Another object is to break through the applying limitation of the screen with mesh and to provide a screen equipment that can select arbitrary granularity. And the equipment can also classify different granularities by one separator.

The vibratory screen without mesh in this invention differs from the traditional vibratory screen with mesh in principles. For the latter, vibration just speeds up the underflowing particles through the mesh holes and the separation is realized simply by bulk selection. For the former, however, vibration lets the mixing material of the same kind or the same density shake up and down by the meshless material trough with flat bottom plate. With gravity and unequal dropping resisting force, material continuously stratify, bigger ones into the upper layer and smaller into the lower. The stratified particles are led out using a special method.

A screenless vibratory separator for separating material of the equal density, consists of a material trough; a vibrating assemble for shaking said material trough; a blade(s) for guiding the stratified particles by vibrating material in said material trough; and a adjuster for the blade(s). The blade tilts in the trough, the upper side of said blade is pivotally joined on a corresponding horizontal axis at the outlet of the material trough and the lower side of said blade forming an acute angle with the bottom of the trough. The material trough have a flat bottom plate supported by a one-freedom frame for making a one-freedom swing. The vibrating assemble consists of vibrators mounted on the material trough in pair and symmetrically to its transversal or longitudinal central line. Each pair of vibrators rotates in the opposing direction, at the same frequency, making a phase difference of 180 degrees, so that restricting the material trough vibrating with only one degree of freedom towards the direction of the front-top part of the outlets. The acute angle is 0–9 degrees and the angle of the upper blade be 1–3 degrees is bigger than that of the lower.

The material trough is an open slot with flat bottom plate, supported by a one-freedom frame. It does one-freedom, i.e., unidirectional, vibration. An outlet is formed at the bottom near the output end.

The one-freedom frame consists of two or more groups of parallelly, aslant, uniformly installed main supports and one or more elastic shock-absorb supports. The upper part of each main support and lower part of each main support are respectively connected with the material trough and the base by horizontal axes. All main supports and the base form the same acute angle, connecting axes of the trough as fulcrums. At the upper part each group of the main supports joins by way of axis the same amount of parallel elastic shock-absorb supports, whose lower part is fixed on the base. The main support and the shock-absorb support, angling 85–95 degrees, jointly uphold the material trough. In addition to supporting, the elastic shock-absorb support can also produce counterforce to strengthen vibration and to have the trough do effective one-freedom, i.e., unidirectional, vibration. The vibrators are mounted on the material trough in pairs symmetrical to its transversal or longitudinal central line. At the same frequency, each pair of vibrator rotates in the opposing direction, making a phase difference of 180 degrees, which restricts the material trough to vibrate one way towards the front-top part of its outlet. The blade consists of one or more oblique flats in the material trough connected with the corresponding horizontal axes at the outlet, forming an acute angle, commonly 1–10 degrees. Every horizontal axis can be moved vertically and locked to adjust the underside of the blade. One or more adjusters for the blade are also designed in the invention to adjust the angle between the blade and the bottom of the material trough, thus controlling the gap between the blade and the outlet at the bottom.

When operating, vibrators keep the particles in the material trough regularly vibrating and being stratified according to granularity, smaller ones in the lower layers and bigger ones in the upper layers. By adjusting the adjusters for the blades or moving and locking the vertical position of the horizontal axes, the undersides of one or more blades can reach a proper outlet for a certain granularity, forming an appropriate gap to discharge the particles of the lower layer. During the course of vibrating, these small particles are discharged from the outlet. And the particles from other layers continue to move towards the output direction and climb up the corresponding blade, then roll away from the trough. Consequently, particles of different granularity are successfully separated.

An interior underlayer or a liner is mounted in the material trough to enhance the screening effect and improve the tear-proof and corrosion-proof performance.

With a vibratory material trough shown instead of traditional structure with mesh, particles can vibrate at a certain type, amplitude and frequency, big ones rising up and small ones sinking down Having vibrated for an appropriate time, the adjuster draw the blade up to let small particles drain out and big ones move towards the output, then climb up the blade and roll away from the trough. Thus particles of different size are separated by vibrating. The invention takes on best separating capability for material of the equal density. It can be applied to such fields as fertilizer, grain, ore and metallurgy. Corresponding to the physical and chemical characters of different material, an interior underlayer or liner is installed to prevent the material trough from corroding and tearing.

The screenless vibratory separator developed in the invention, especially the type of multi-blade, is well fit for the industrial production needing mass classification of material, e.g., ore dressing, separating grain in food production and screening coal at coal-field. For sintered ore, a separator with a working surface of 1000 mm wide and 2000 mm long has a handling capacity of 180 tons per hour.

The following sections will describe the invention in detail using some attached figures and demonstrations.

DETAILED DESCRIPTION OF THE INVENTION

Figure 1:
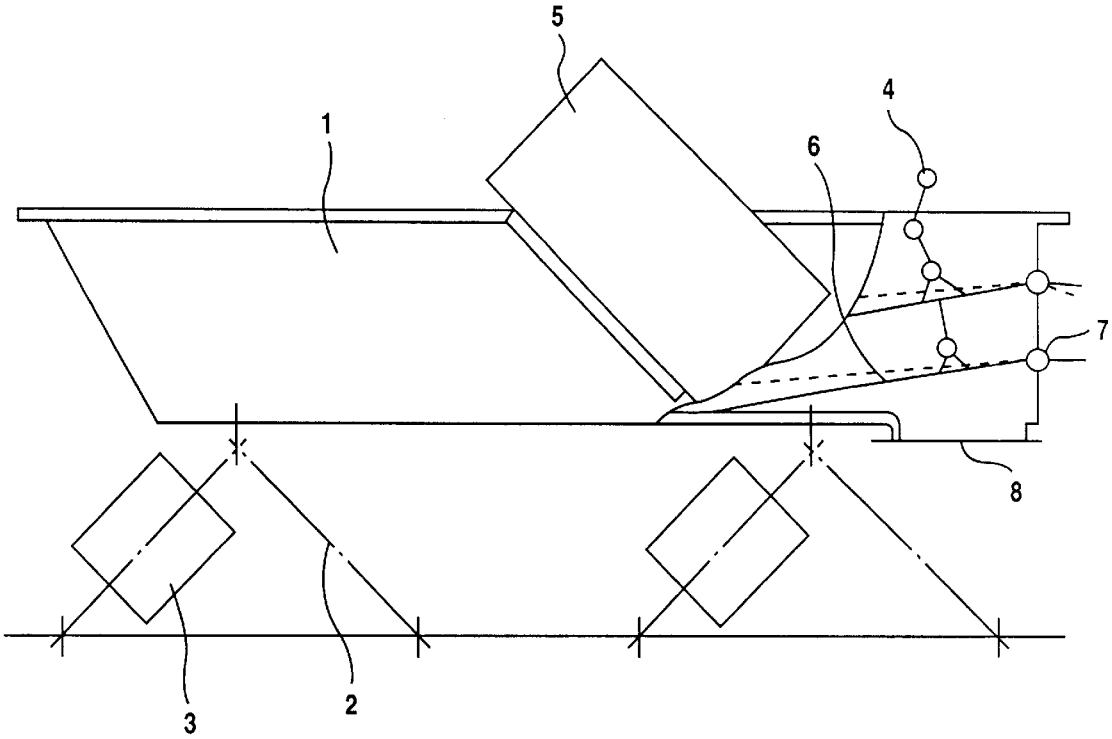
FIG. 1 shows the structural sketch of a screenless vibratory separator with vibrators symmetrically mounted on the two sides of the material trough.

FIG. 1 indicates that the material trough 1 is a slot with a flat bottom plate. At the bottom near the output end is an outlet 8,covered by the blade 6. One side of the blade 6 is connected with the horizontal axis 7 and out of the material trough; the other relies on the trough. One end of the adjuster 4 for the blade is installed in the middle under the blade 6, the other joins to a top bar (not shown in the figure). The one-freedom main support 2 and the elastic shock-absorb support 3 hold up the body of the material trough 1.

Several blades 6, connected with the horizontal axes perpendicular to the output end separately, compose of a blade group. Adjusting each blade 6 by one or more adjuster 4, material with more than two levels of granularity can be classified at the same time. In the case each blade forms its own angle to the trough 1. The angle of an upper blade is normally 1–3 degrees bigger than that of a lower one.

Properly choosing the mutual installing position of the one-freedom support 2, the elastic shock-absorb support 3 and the vibrator 5, material trough 1 produces variant types of vibration, tuning the screening efficiency.

Figure 2:
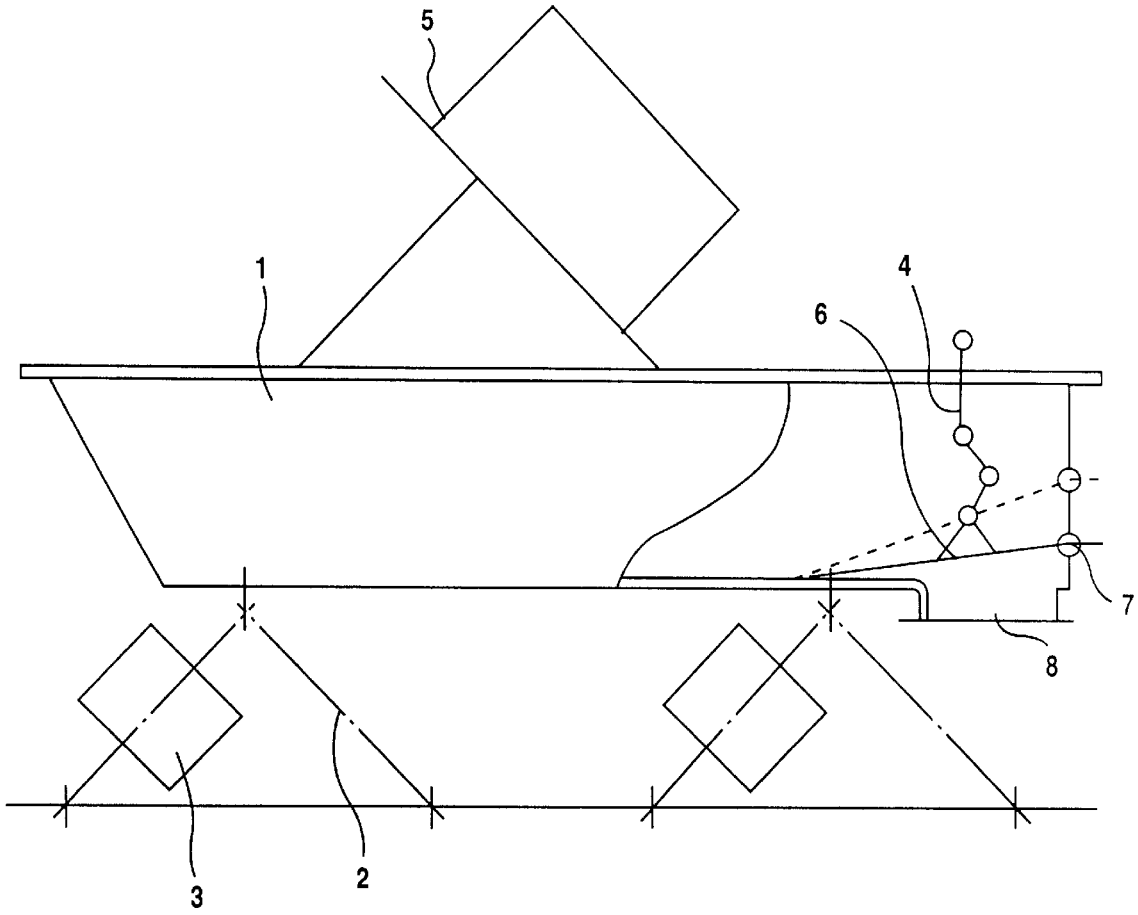
FIG. 2 is the structural sketch of a screenless vibratory separator with vibrators symmetrically installed above the material trough.

FIG. 2 is the structural sketch of a screenless vibratory separator with vibrators 5 symmetrically installed above the material trough 1. At the actionless stat, the blade 6 and the bottom of the trough 1 form an acute angle. And the horizontal axis can move upward vertically.

Figure 3:
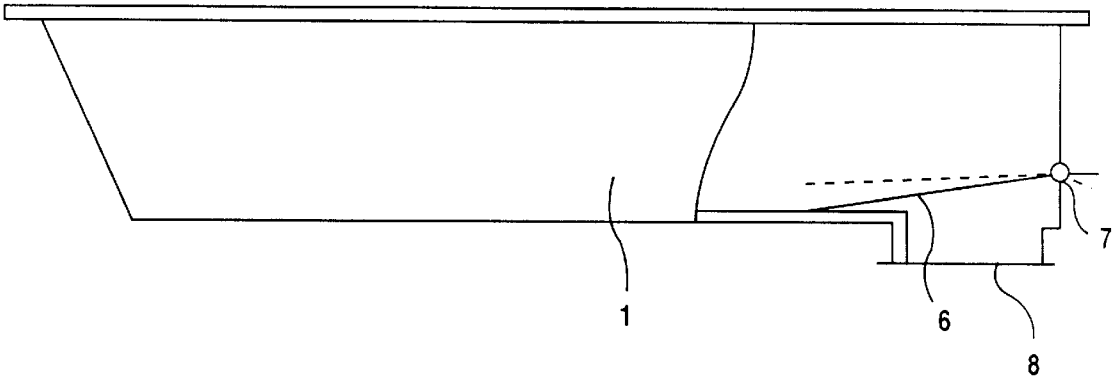
FIG. 3 indicates the angle sketch of the blade in the material trough.

FIG. 3 only shows the sketch of the horizontal axis at the lowest position. When the blade 6 completely covers the outlet, the angle is an acute one. Once the blade 6 opens, it falls into a scope between 9 degrees and 0 degree, the optimal working angle for the blade.

Figure 4:
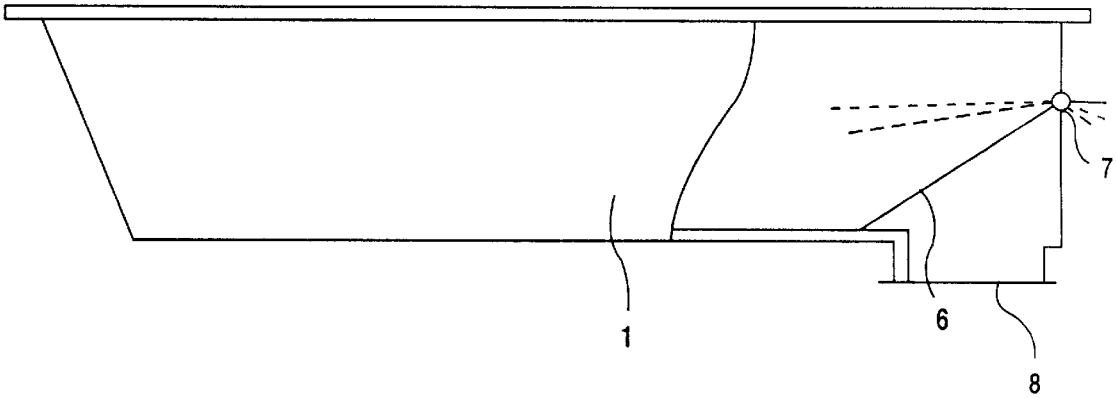
FIG. 4 gives the angle sketch of the blade in the material trough when the horizontal axis moves upward.

FIG. 4 gives an arbitrary position of the horizontal axis. When the blade completely covers the outlet, the angle is not smaller than the working angle, an angle still between 9 degrees and 0 degree.

Figure 5:
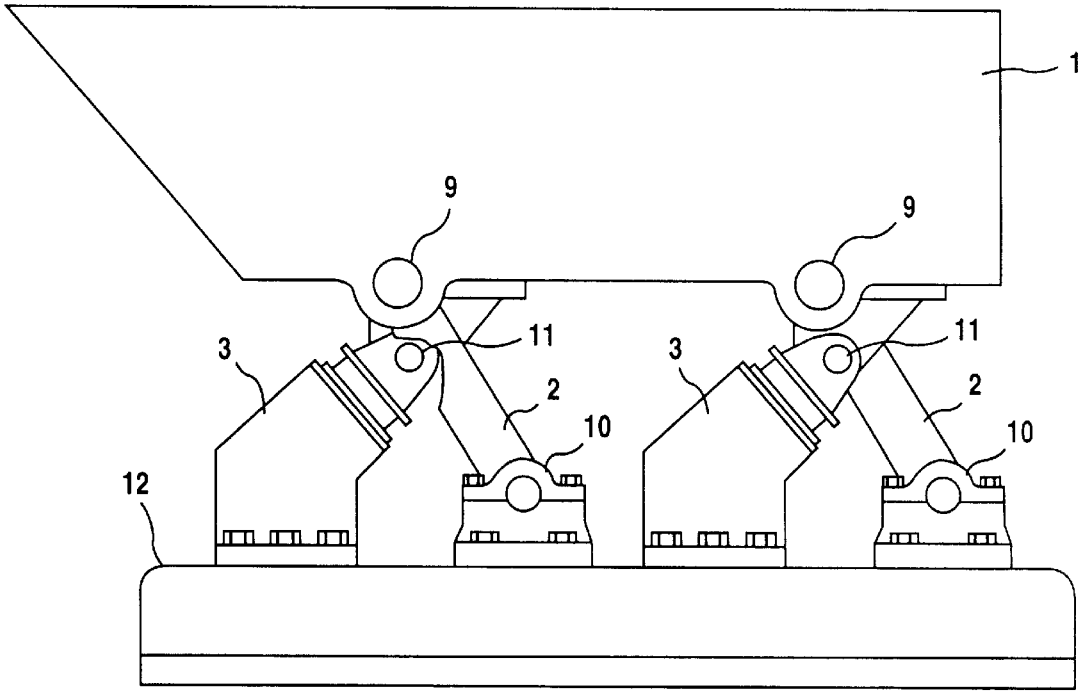
FIG. 5 displays the structural sketch how the one-freedom frames uphold the material trough.

FIG. 5 displays the structural sketch how the one-freedom frames uphold the material trough 1. As shown in the figure, the screenless vibratory separator provided by the invention includes two groups of one-freedom frames, each of which consists of a parallel oblique main support 2, actively connected with the axis 9, and an elastic shock-absorb support 3, intercrossing perpendicularly to and join to the main support 2 by the axis 11. The underside of the main support 2 is connected with the base 12 by the axis 10. But that of the elastic shock-absorb support 3 is fixed to the base 12. Both of the one-freedom frames support the material trough by axis 9 respectively. Once power is on, vibrator 5 starts to shake the trough 1, stratifying the particles, bigger ones to the upper layer and smaller ones to the lower Having vibrated for an appropriate time, the stratified particles move towards the outlet, then climb up the corresponding blade and roll away from the trough 1. With the pushing of the top bar, the adjuster for the blade 4 draws the blade up, making the angle between the lower blade and the output hole of particles just suit to discharge small particles from the outlet 8. Thus particles of different granularity are separated by vibrating. This invention takes on best separating capability for dry material of the equal density It can be applied to such fields as fertilizer, grain, ore and metallurgy.

What is claimed is:

1. A screenless vibratory separator that separates material of equal gravity, comprising:

a base;

a material trough connected to said base, said material trough having a horizontal axis parallel relative to said base and a flat bottom parallel with said horizontal axis and a material outlet located at an end of said flat bottom, said material trough configured to hold the material therein;

a vibrating device mounted to said material trough, said vibrating device vibrates said material trough to stratify particles of the material, said material trough reciprocating only along a line angled 45° relative to said flat bottom of said material trough;

a pivotable blade that guides the stratified particles to be discharged through said material outlet, said pivotable blade located substantially above said material outlet having a base end connected to said material trough at a point parallel relative to said horizontal axis and a blade that forms an acute angle relative with said flat bottom of said material trough;

an adjuster that adiusts a position of said blade; and a one-freedom frame that connects said base to said material trough and supports said flat bottom to provide a one-freedom swing, wherein said vibrating device includes a plurality of vibrators mounted to said material trough in pairs to be symmetrical relative to a longitudinal central line of said material trough, wherein each pair of said vibrators rotate in opposing directions relative to each other while at a common frequency resulting in a phase difference of 180°, so that said material trough vibrates in one degree of freedom towards said material outlet, wherein said acute angle is in a range between 0–9°.

2. The screenless vibratory separator according to claim 1, wherein said one-freedom frame includes at least two pairs of parallel oblique main supports and elastic shock-absorb supports, an upper part of each main support is connected to said flat bottom of said material trough and a lower part of each main support is connected to said base by horizontal axes, wherein said elastic shock-absorb supports are connected to said main supports, at an angle between 85°–95°.

3. The screenless vibratory separator according to claim 1, wherein said adjuster moves said base end of said blade vertically relative to said horizontal axis.

4. The screenless vibratory separator according to claim 1, further comprising an under layer of erosion-resistance and tear-and-wear-resistance material mounted to said material trough.

5. The screenless vibratory separator according to claim 1, wherein a mutual position of said main supports, said elastic shock-absorb supports and said vibrator device is adjustable.

* * * * *